United States Patent [19]

Hanya

[11] Patent Number: 4,707,143

[45] Date of Patent: Nov. 17, 1987

[54] DEVICE FOR DRIVING TWIST PENDULUMS

[75] Inventor: Masao Hanya, Tokyo, Japan

[73] Assignee: Seikosha Co., Ltd., Tokyo, Japan

[21] Appl. No.: 915,808

[22] Filed: Oct. 6, 1986

[30] Foreign Application Priority Data

Oct. 7, 1985 [JP] Japan ..... 60-222995

[51] Int. Cl.[4] ..... G04B 17/02

[52] U.S. Cl. ..... 368/165; 368/179; 368/223

[58] Field of Search ..... 368/76, 134, 165, 179, 368/180, 223; 40/426, 439, 440

[56] References Cited

U.S. PATENT DOCUMENTS 2,185,805 1/1940 Feiner ..... 368/179
4,613,236 9/1986 Nakamura ..... 368/165
4,624,589 11/1986 Sagawa ..... 368/134

FOREIGN PATENT DOCUMENTS 369705 3/1932 United Kingdom ..... 368/179

*Primary Examiner*—Vit W. Miska
*Attorney, Agent, or Firm*—Bruce L. Adams; Van C. Wilks

[57] ABSTRACT

A device for driving multiple twist pendulums for a table clock is constructed such that the twist pendulums are arranged so as to operate independently of each other and are driven to rotate in directions opposite to each other. One twist pendulum is connected to a first pendulum shaft which depends from a body casing a greater distance than a second pendulum shaft which is in the form of a cylinder and which concentrically surrounds the first pendulum shaft. A gear train interconnects the pendulum shafts with a single driving wheel and a driving coil to provide the motive force to drive the twist pendulums.

1 Claim, 3 Drawing Figures

DEVICE FOR DRIVING TWIST PENDULUMS

BACKGROUND OF THE INVENTION

The present invention relates to a device for driving twist pendulums.

Conventionally, a twist pendulum has been used for a table clock or the like. Generally, the pendulum is attached to a lower portion of a pendulum shaft projecting downward from a mechanism casing, and is driven to rotate by magnetic action between a magnet and a driving coil housed in the casing, while the rotational angle of the pendulum is restricted by spring force of a hair spring, so that the pendulum continues the rotation repeatedly.

Recently, it has been said that the market for twist pendulum clocks is changing from the mass consumption one to the individualized and sensitized one. In order to cope with such a change, it is necessary to make the added value of the commodity high, and a great demand for a commodity cannot be expected unless individuality or unexpectedness is provided to the commodity. In this point of view, the conventional twist pendulum can not satisfy the variety of requirements of various demands in the market because there is provided only one pendulum on a pendulum shaft, such that the pendulum is very simple in movement, monotonous as a whole, has few decorative parts, and thus lacks interest as a commodity.

An object of the present invention is to provide a device for driving twist pendulums in which the twist pendulum is made to have a more decorative functional appeal and to have a change in movement so as to raise the value of the commodity.

According to the present invention, in a device for driving twist pendulums, there is provided a pendulum shaft operating as a driving shaft and a pipe-like pendulum shaft arranged concentrically with the first-mentioned shaft. Twist pendulums are attached to the respective pendulum shafts, a driving wheel and a transmission gear are provided on the first-mentioned pendulum shaft, a drive transmission gear is provided on the second pendulum shaft, and the driving wheel is arranged to be driven to rotate by magnetic force between a magnet and a driving coil and the rotational angle of the driving wheel is restricted by spring force of a hair spring. There is also provided an intermediate gear for transmitting the rotating force of the transmission gear on the first pendulum shaft to the drive transmission gear, and the drive transmission gear and the transmission gear are made to reverse their respective directions of rotation.

Being driven by the driving wheel, the first of the pendulum shafts is rotated so as to rotate one of the twist pendulums in a first predetermined direction, and then the rotation of that twist pendulum is reversed by the spring force of the hair spring, the reversible rotation being repeated in the same manner in a predetermined rotational angle. The other pendulum shaft is also rotated by the rotating force of the driving wheel, but the force to do so is transmitted from a transmission gear on the first pendulum shaft to a drive transmission gear on the second pendulum shaft through an intermediate gear wheel, so that the second twist pendulum is rotated and then reversed. Thus, the second twist pendulum is rotated in a predetermined angle in the direction opposite to the first twist pendulum and then it also is reversed.

DETAILED DESCRIPTION OF PREFERRED EMBODIMENTS

Figure 1:
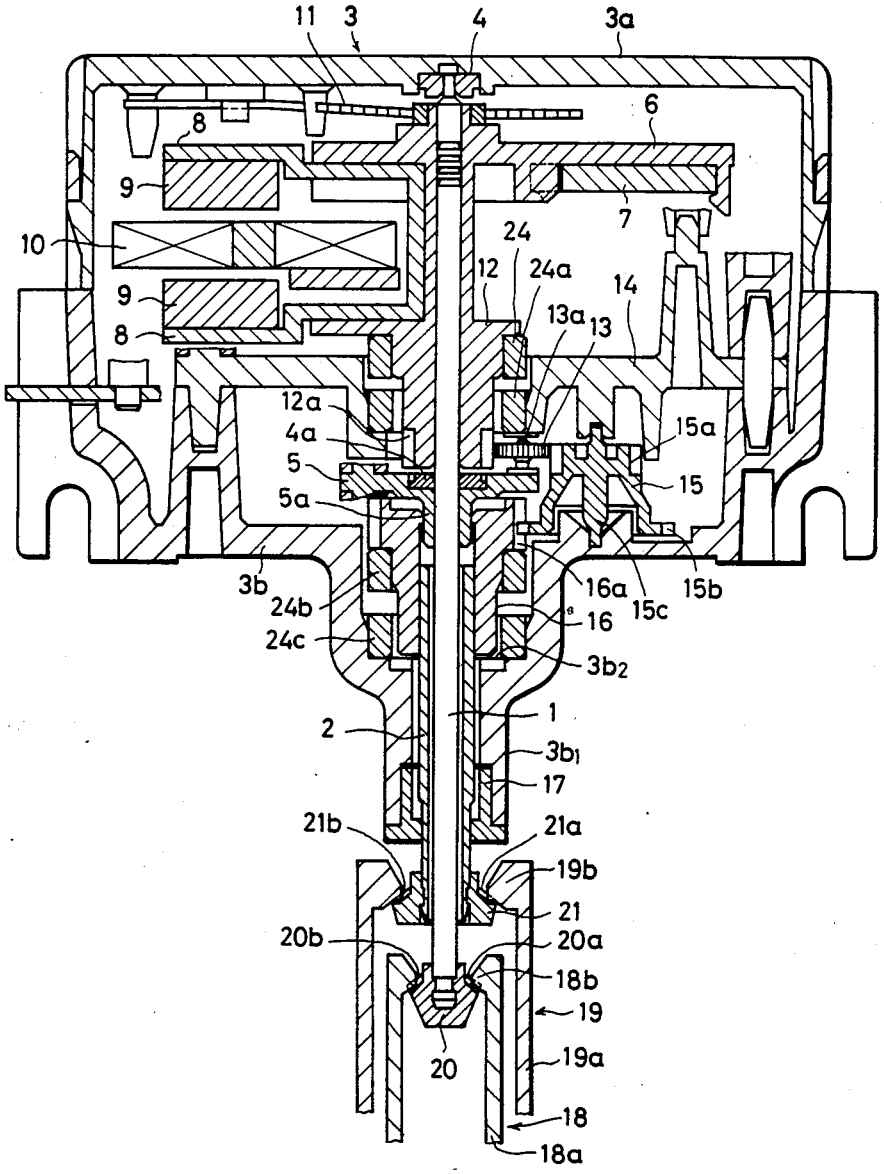
FIG. 1 is a longitudinal cross-section of a device incorporating the invention.
Figure 2:
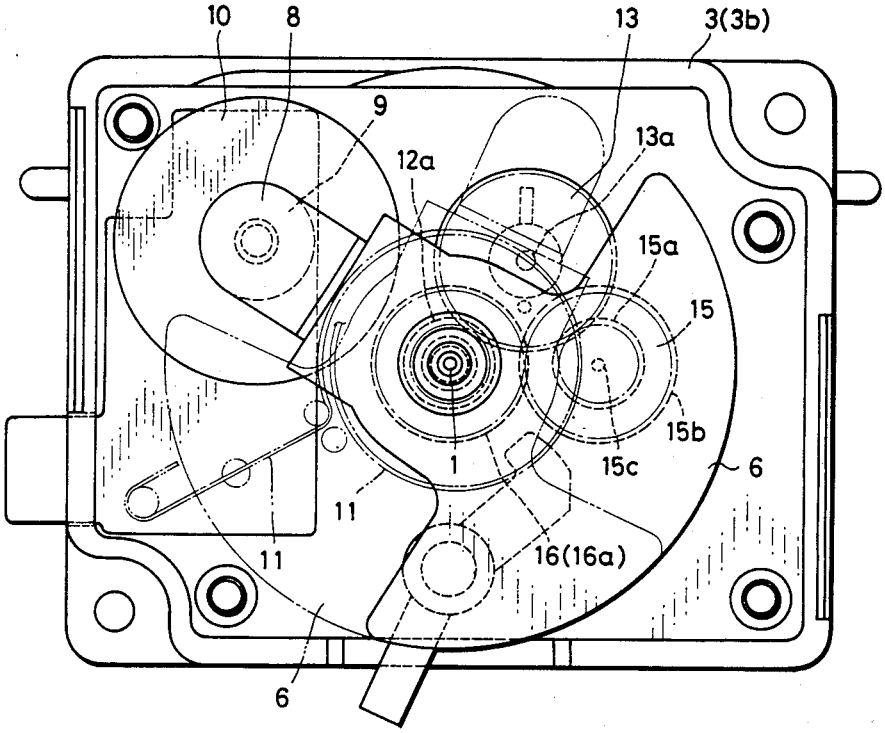
FIG. 2 is a plan view of a main portion of the same device.

Referring to the drawings, an embodiment according to the present invention will be described hereunder. In FIGS. 1 and 2, a pendulum shaft 1 acting as a driving shaft and a pipe-like or cylinder-like pendulum shaft 2 linked with the pendulum shaft 1 to be rotated are vertically mounted in a mechanical body casing 3 concentrically with each other.

The pendulum shaft 1 is rotatably supported at its upper end and intermediate portions by a bearing 4 provided on an inner surface of an upper casing 3*a* of the mechanism casing 3 and by a bearing 4*a* fixed on a first inner plate 5 horizontally provided in a lower casing 3*b*, respectively. A flat T-shaped (see FIG. 2) driving wheel 6 is fixed on the upper end portion of the pendulum shaft 1. A plate-like balancer 7 is attached to the driving wheel at one side on the lower surface of the latter and two yokes 8 and 8 are horizontally provided on the other side of the driving wheel 6 separately from each other and at a predetermined interval. Disk-like magnets 9 and 9 are attached respectively on the surfaces of the respective yokes facing each other. A ring-like driving coil 10 fixed on a holder projecting from a side wall of the mechanism casing 3 is disposed between the magnets so that the driving wheel 6 can be driven to rotate in a predetermined direction by a magnetic action of the driving coil and the magnets. Therefore, the pendulum shaft 1 is rotatable in the same direction as that of the driving wheel 6 to which it is affixed. A hair spring 11 is arranged between the upper end portion of the pendulum shaft 1 and the inner surface of the upper casing 3*a*, so that the respective rotational angles of the driving wheel 6 and the pendulum shaft 1 are restricted by the spring force of the spring which causes them to be reversely rotated in a predetermined angle.

The rotating force of the pendulum shaft 1 is transmitted to the cylinder-like, concentric pendulum shaft 2 through a transmission mechanism. That is, a transmission gear 12 is fixed to the pendulum shaft 1 at its intermediate portion. The gear 12 is provided at its lower side with a toothed portion 12*a* and the lower end surface of the gear 12 is positioned adjacent to the upper surface of the bearing 4*a* of the first inner plate 5. A first intermediate gear 13 is engaged with the toothed portion 12*a* of the transmission gear 12. The upper and lower ends of a shaft 13*a* of the first intermediate gear 13 are respectively pivoted by respective bearing portions of the first inner plate 5 horizontally provided in lower casing 3*b* and a second inner plate 14. An upper toothed portion 15*a* of a second intermediate gear 15 is engaged with the first intermediate gear 13, the number of teeth of the toothed portion 15*a* being selected to be the same as that of the toothed portion 12*a* of the transmission gear 12. A shaft 15*c* of the second intermediate gear 15 is rotatably supported by the respective bearing portions of the second inner plate 14 and the lower casing 3*b*. A lower toothed portion 15*b* of the second intermediate gear 15 is engaged with a toothed portion 16*a* of a drive transmission gear 16 having the same number of teeth as that of the toothed portion 15*b*. The drive transmission gear 16 is made in the form of a sleeve or cylider and is pressingly inserted onto the pipe-like or cylindrical pendulum shaft 2 at an upper portion of the latter, the gear 16 being fitted at its upper center portion with a bearing portion 5*a* vertically extended down from the first inner plate 5 so as to be used also as a bearing at the upper end of the pendulum shaft 2. The lower end surface of the drive transmission gear 16 is made adjacent to an inside portion $3b_2$ of an intermediate reduced portion of a cylindrical portion $3b_1$ projected down from the outer surface of the lower casing 3*b*.

The cylindrical or pipe-like pendulum shaft 2 is fitted over the lower half portion of the pendulum shaft 1 and the lower portion of the pendulum shaft 2 is supported by a sleeve-like bearing 17 pressingly inserted in a lower end opening portion of the cylindrical portion $3b_1$ of lower casing 3*b*. The lower end portion of the pendulum shaft 2 is projected down from the lower end of the cylindrical portion $3b_1$ of lower casing 3*b* together with the pendulum shaft 1, and the pendulum shaft 1 is further extended down from the lower end of the pendulum shaft 2 so as to be exposed therebelow.

Figure 3:
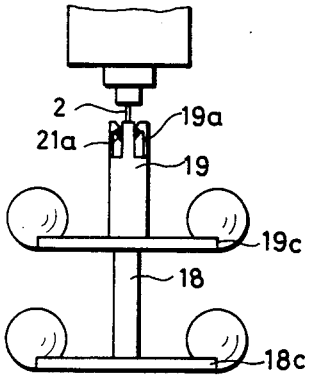
FIG. 3 is a diagram in plan view for explaining the manner in which the twist pendulums are attached.

Hooks 20 and 21 for hooking twist pendulums 18 and 19 respectively are pressingly inserted onto the respective lower ends of the pendulum shafts 1 and 2. Convex hooking surfaces 20*a* and 21*a* are formed on the whole outer circumferences of the hooks 20 and 21 respectively. Protrusions 18*b* and 19*b*, which are formed on upper portions of four arm portions 18*a* and 19*a* provided respectively on the twist pendulums 18 and 19 coaxially arranged as shown in FIGS. 1 and 3, are hooked respectively by the hooking surfaces 20*a* and 21*a*. Accordingly, as the pendulum shafts 1 and 2 rotate, the twist pendulums 18 and 19 can rotate integrally with the shafts 1 and 2. In order to make the integral rotation more effective, four engageable recess portions 20*b* and 21*b* are equidistantly provided in the hooking surfaces 20*a* and 21*a* so that the respective protrusions 18*b* and 19*b* of the four arms are made engageable with the recess portions respectively. As shown in FIG. 3, the one twist pendulum 18 is projected down at its lower portion from the lower end of the other twist pendulum 19, and pendulum decorations 18*c* and 19*c* are horizontally attached on the lower ends of the respective pendulums.

The pendulum shafts 1 and 2 are lowered or urged downward by the respective weights of the twist pendulums 18 and 19. Accordingly, as to the pendulum shaft 1, the lower surface of the transmission gear 12 comes into contact with the bearing 4*a*, while as to the pendulum shaft 2, the drive transmission gear 16 comes into contact with the inside portion $3b_2$ of the cylindrical portion $3b_1$ of lower casing 3*b*, so that there is a risk that the twist pendulums (pendulum shafts) may be prevented from rotating smoothly by the frictional resistance so created. Therefore, there is provided friction-free means as shown in FIG. 1. That is, a pair of magnet rings 24 and 24*a* provided on the upper outer circumferential portion of the transmission gear 12 and on the second inner plate 14 respectively are made vertically opposite to each other so that the respective magnetic poles of the magnets repel each other to always keep the transmission gear 12 in a floating state to thereby keep the lower end surface of the gear 12 urged upwards and thus separated from the bearing 4*a*. Similarly to this, a pair of magnet rings 24*b* and 24*c* are attached on the drive transmission gear 16 and on the inner portion of the cylindrical portion $3b_2$ of lower casing 3*b* respectively so as to make the drive transmission gear 16 float by the repellent force between the magnet rings.

Next, operations of the twist pendulums 18 and 19 are described.

The driving wheel 6 is forwardly rotated by the magnetic action between the magnets 9 and the driving coil 10 and then reversely rotated by the spring force of the hair spring 11, and at the same time transmission gear 12 which is affixed to the pendulum shaft 1 is rotated and reversed in the same direction as the driving wheel 6, so that the twist pendulum 18 depending from pendulum shaft rotates, for example, clockwise over 180 degrees and then reversely rotates with the same rotational angle (180 degrees, for example). Additionally, the driving force of the pendulum shaft 1 is transmitted to the drive transmission gear 16 through the transmission gear 12, and the first and second intermediate gears 13 and 15 respectively, to also rotate and reversely rotate the pendulum shaft 2. Because the transmission gear 12 rotates clockwise, the drive transmission gear 12 rotates counterclockwise owing to the existence of the two intermediate gears 13 and 15, so that the twist pendulum 19 depending from the pendulum shaft 2 is also rotated counterclockwise over a rotational turning angle of 180 degrees and then reversely rotated. Accordingly, the twist pendulums 18 and 19 always rotate in the opposite directions to each other. The rotational angle and the cycle of the twist pendulum 18 are the same as those of the twist pendulum 19 because the number of teeth of the toothed portion 12*a* of the transmission gear 12 is the same as that of the toothed portion 15*a* of the second intermediate gear 15, and the number of teeth of the toothed portion 15*b* is the same as the number of teeth of the toothed portion 16*a* of drive transmission gear 16, as described above.

Although the intermediate gears are provided in plural in number, a single gear may be used. In such case, for example, the the transmission gears 12 and 16 can be reversed in rotational direction by using a crown gear (not shown) so that twist pendulums 18 and 19 still always rotate in opposite directions.

According to the present invention, the twist pendulums are arranged to operate independently of each other and are driven to rotate in directions opposite to each other, so that the combination of operations of the pendulums can give changes in movement of the pendulums, can make the decorative and functional appeal high, and can provide unique twist pendulums to raise the value of the commodity.

What is claimed is:

1. A device for driving twist pendulums comprising:

a pendulum shaft operating as a driving shaft;

a pipe-like pendulum shaft arranged concentrically with said pendulum shaft:

a driving wheel provided on said first-mentioned pendulum shaft and arranged to be driven to rotate forwardly by the magnetic force between a magnet and a driving coil and to be driven to rotate reversely by the spring force of a hair spring;

a transmission gear provided on said first-mentioned pendulum shaft;

an intermediate gear wheel connected to receive the rotating force of said transmission gear;

a drive transmission gear provided on said pipe-like pendulum shaft and arranged to receive the rotating force of said intermediate gear wheel, said drive transmission gear being rotated in the direction opposite to said transmission gear; and said pendulum shafts being arranged such that twist pendulums can be attached to said respective pendulum shafts.

* * * * *